US009043125B2

(12) United States Patent
Dufournier

(10) Patent No.: US 9,043,125 B2
(45) Date of Patent: May 26, 2015

(54) DEVICE AND PROCESS FOR VEHICLE DRIVING EVALUATION

(75) Inventor: Arnaud Dufournier, Beaumont (FR)

(73) Assignee: DUFOURNIER TECHNOLOGIES, Riom (FR)

( * ) Notice: Subject to any disclaimer, the term of this patent is extended or adjusted under 35 U.S.C. 154(b) by 205 days.

(21) Appl. No.: 13/212,554

(22) Filed: Aug. 18, 2011

(65) Prior Publication Data

US 2013/0046458 A1 Feb. 21, 2013

(51) Int. Cl.
*G06G 7/70* (2006.01)
*G07C 5/08* (2006.01)

(52) U.S. Cl.
CPC ..... *G07C 5/085* (2013.01); *G07C 5/0816* (2013.01)

(58) Field of Classification Search
USPC ..... 701/33, 38, 85; 700/295; 705/30; 73/432.1; 180/282; 250/372; 382/281
See application file for complete search history.

(56) References Cited

U.S. PATENT DOCUMENTS

| | | | | |
|---|---|---|---|---|
| 4,671,111 | A * | 6/1987 | Lemelson | 73/432.1 |
| 4,845,630 | A | 7/1989 | Stephens | |
| 5,867,803 | A * | 2/1999 | Kim et al. | 701/85 |
| 2005/0004730 | A1* | 1/2005 | Suzuki et al. | 701/38 |
| 2005/0257981 | A1* | 11/2005 | Iyoda et al. | 180/282 |
| 2005/0281198 | A1* | 12/2005 | Miyamoto et al. | 370/235 |
| 2006/0266950 | A1* | 11/2006 | Acevedo et al. | 250/372 |
| 2009/0245687 | A1* | 10/2009 | Jeon et al. | 382/281 |
| 2010/0292860 | A1* | 11/2010 | Komiya et al. | 700/295 |
| 2011/0106370 | A1* | 5/2011 | Duddle et al. | 701/33 |
| 2011/0137763 | A1* | 6/2011 | Aguilar | 705/30 |

FOREIGN PATENT DOCUMENTS

| | | |
|---|---|---|
| FR | 2923290 | 5/2009 |
| WO | 8301686 | 5/1983 |

* cited by examiner

*Primary Examiner* — James Trammell
*Assistant Examiner* — Sanjeev Malhotra
(74) *Attorney, Agent, or Firm* — Rothwell, Figg, Ernst & Manbeck, P.C.

(57) ABSTRACT

Device (10) for vehicle driving evaluation comprising:

A means (11) to obtain at least one physical parameter whereby it possible at any time to determine the value of the speed and instantaneous acceleration of a traveling vehicle;

A calculation and comparison unit (12) whereby it is possible, from said physical parameter, to calculate an effective parameter that depends on said instantaneous acceleration and to compare said effective parameter with a reference parameter;

A driving evaluation unit (13), whereby it is possible to generate a vehicle driving energy score by measuring the variance between said effective parameter and said reference parameter.

Corresponding vehicle driving evaluation process.

19 Claims, 4 Drawing Sheets

DEVICE AND PROCESS FOR VEHICLE DRIVING EVALUATION

TECHNICAL FIELD OF THE INVENTION

The invention relates to a device for the evaluation of vehicle driving energy whereby a vehicle driving energy score is generated. The invention further relates to a vehicle driving evaluation process whereby a vehicle driving energy score can also be generated.

STATE OF THE PRIOR ART

Systems are known that measure vehicle fuel consumption. Some of these systems offer functions designed to favor fuel savings. However, these known systems are essentially based on consumption measurement.

Consumption measurement integrates the performance of the engine and the performance of the power transmission system (gear box, sometimes with automatic gear change, differentials, bearings and tires), the effect of the load carried and the vehicle weight, the effect of aerodynamics, the effect of outside ambient conditions such as the weather (wind, rain, etc.), the effect of the route (inclines and alternating up- and downgrades, bends, vertical evenness of road surface, etc.), the effect of traffic conditions (free-flowing traffic, congestion, accidents, road works, etc.), the effect of the traveling environment (interurban, urban, city-center, open highway, etc.), the presence of traffic lights, roundabouts or junctions that require the vehicle to stop, so increasing its fuel consumption when pulling away, and also the driver's driving style.

For example, Document U.S. Pat. No. 4,845,630 describes a device and a process whereby a corrected consumption rate is calculated. In addition to a conventional flow meter, the device comprises a series of sensors, including a distance sensor designed to evaluate the variation in the kinetic energy of the vehicle. A microprocessor takes into account this energy to correct the measured consumption.

WO 83/01686 describes a system whereby it is possible to correct the instantaneous measurement of consumption per unit distance traveled according to the different forms of energy accumulated by the vehicle. The signals from the sensors used and the corrected consumption are shown to the driver by means of a display.

FR 2 923 290 describes an in-car display comprising an energy value indicator, one dimension of which represents the energy stored in an electrical energy source in the car, and a transfer direction indicator designed to show in which direction energy is being transferred, whether from or to the electrical energy source. The display further comprises an indicator showing the kinetic energy of the vehicle, one dimension of which represents at least the part of the kinetic energy of the vehicle derived from the electrical energy source. The electrical energy considered is the energy derived from the electrical source that serves to move the vehicle.

None of these devices offers a way to extract a rating or score or any other mode of evaluation, or any value or index that is technically objective and linked solely or mainly to how economically the driver is driving the vehicle.

In the existing devices, the effects of the route and the road conditions are generally preponderant, ruling out an evaluation criterion focused mainly on the driving quality.

Further, the existing devices cannot be readily and cheaply added on to existing vehicles.

The invention offers various technical means to overcome these different shortcomings.

PRESENTATION OF THE INVENTION

First, the primary object of the invention is a device and a process designed to evaluate how economically a vehicle is being driven, independently of the parameters inherent to the vehicle itself and (or) to the route traveled and the environment thereof.

A further object of the invention is a device and process designed to manage a fleet of vehicles so as to minimize its fuel costs.

A further object of the invention is a device designed to evaluate how economically an existing vehicle is being driven.

A further object of the invention is a device and process designed to show a driver how driving style influences fuel consumption.

To this end, the invention comprises a process to evaluate how economically a vehicle is being driven (by a driver), or to measure driving energy, in the following steps:

At least one physical parameter is obtained (by calculation or measurement) whereby it is possible at any time to determine the value of the speed and instantaneous acceleration of a traveling vehicle;

From said physical parameter, an effective parameter is calculated that depends on the instantaneous acceleration or speed of the vehicle;

This effective parameter is compared with a reference parameter;

A driving energy score (or driving score) is calculated for the vehicle from the variance between the effective parameter and the reference parameter.

The score may be given as an instantaneous value or else averaged for a given journey or part thereof.

This process cancels out the effects specific to the vehicle and those of the outside ambient conditions. Further, the comparison with a reference simulating economically optimal driving cancels out the effects of the route and the traffic conditions.

These two functions are specific and provide different, complementary gains. They cancel out numerous other parameters that confound the results of known processes and devices, in particular those based on consumption and that do not make any comparison with a reference.

The process cancels those parameters over which the driver has no direct control, such as the parameters associated with the vehicle as a whole: aerodynamics, engine (performance and settings), transmission (including the gearbox and its settings when automatic), tires and rolling resistance, together with outside ambient conditions such as weather (outside temperature, wind, rain, snow, etc.) and loading conditions.

Iso-contextual comparison with a reference parameter cancels out the effect of the route traveled. Thus the impact of bends, up- and downgrades, obstacles, traffic lights, roundabouts and junctions, and traffic conditions (congestion, accidents, road works, etc.) is canceled out.

The process further makes it possible to give the driver an indication of driving quality, and also to deliver a driving quality monitoring report. Such information can in particular be useful to a vehicle fleet manager or driving instructor.

In an advantageous embodiment, the effective parameter and the reference parameter depend on at least one parameter chosen from a list comprising speed, longitudinal acceleration, transverse acceleration, energy, work (Fd, where F=ma), power (energy per unit time), road incline and road bend radius, and geographical location.

The physical parameter is advantageously the geographical location of the vehicle at any given time. This location is preferably provided by a geopositioning system, e.g. the global navigation satellite system GPS (Global Positioning System). The availability of such a system makes it possible to fit the device on any vehicle without having to interface it with a bus or any other mode of connection to the vehicle data management system.

In an advantageous embodiment the physical parameter is the instantaneous speed. This parameter can be measured by a known type of speed sensor.

In another embodiment the physical parameter is instantaneous acceleration. This parameter can be measured by a known type of acceleration sensor or calculated from instantaneous speeds.

The vehicle driving energy score is advantageously a function of the variance between the effective energy level and a reference energy level. This variance derives essentially from the driver's driving style, which has a direct impact on the effective energy expenditure.

The use of reference parameters may be compared to the use of a simulator. The simulator is a driver model that uses the identified route and applies a "calm" or "reasoned" driving style, i.e. optimized in terms of energy saving. For example, the simulator comprises not only maximal acceleration limits defined by speed ranges and deceleration limits also defined by speed ranges, but also speed limits on bends based on transverse acceleration and in some cases induced angular velocity.

The reference energy value is advantageously a function of a chosen optimal trade-off between favorable energy consumption and reasonable journey time, i.e. high fuel savings should not make the journey excessively long.

Advantageously, the score generated expresses the energy expended linked solely to the way the vehicle is being driven, by which is meant irrespective of energy consumption linked to vehicle engineering features, such as friction, yield, etc., of physical characteristics of the route traveled, such as bends, inclines, grades, type of road surface, etc., and of environmental traveling conditions, such as temperature, precipitations, wind, humidity, traffic density, etc.

The invention further consists of a vehicle driving evaluation device (or driving energy measurement device) comprising:

- A means to obtain at least one physical parameter whereby it is possible at any time to determine the value of the speed and instantaneous acceleration of a traveling vehicle;
- A calculation and comparison unit whereby it is possible, from said physical parameter, to calculate an effective parameter that depends on said instantaneous acceleration and to compare said effective parameter with a reference parameter;
- A driving evaluation unit (or driving energy unit), whereby it is possible to generate a vehicle driving energy score (or driving score) by measuring the variance between said effective parameter and said reference parameter.

The score can take the form of an instantaneous value or else an averaged or integrated value for a given journey or part thereof.

Advantageously, the vehicle driving evaluation device can comprise a geopositioning device.

The use of a geopositioning system makes it unnecessary to use several sensors each serving to measure a different parameter. Costs are thus greatly reduced and modes of installation are made much more flexible. In addition, geopositioning data make it possible not only to calculate speed, acceleration, etc., but also to use cartographic data describing the traveling context.

In an advantageous variant, the vehicle driving evaluation device further comprises a unit for calculating the speed and acceleration of the vehicle, linked to or integrated into the geopositioning system, whereby it is possible to determine the speed and (or) the acceleration of the vehicle from data on its location supplied by the geopositioning system.

DESCRIPTION OF FIGURES

All the embodiment details are given in the following description, completed by FIGS. 1 to 4, presented solely as non-limiting examples, where.

DETAILED DESCRIPTION OF THE INVENTION

Economy driving criteria are based on the quantity of energy expended to travel from one point to another. The criteria used are based on the energy involved in the dynamics of the moving vehicle (kinetic energy), and not the energy specifically consumed by the engine or other mechanical systems in the vehicle, such as the gear box or transmission, in particular. These criteria thus focus on the quality of the driving and are independent of the engine and all other parts of the energy transmission system, and of the aerodynamic performance of the vehicle.

Economy driving is an attitude to driving combining fuel-saving and environment-sensitive driving. Economy driving protects the environment not only by reduced emission of gaseous pollutants, linked mainly to fuel consumption, but also by reducing waste, e.g. brake linings. The economy derives not only from lower fuel consumption, but also from reduced wear on consumable working parts (e.g. tires and brake linings) and general wear on the vehicle (e.g. on the running gear).

Figure 1:
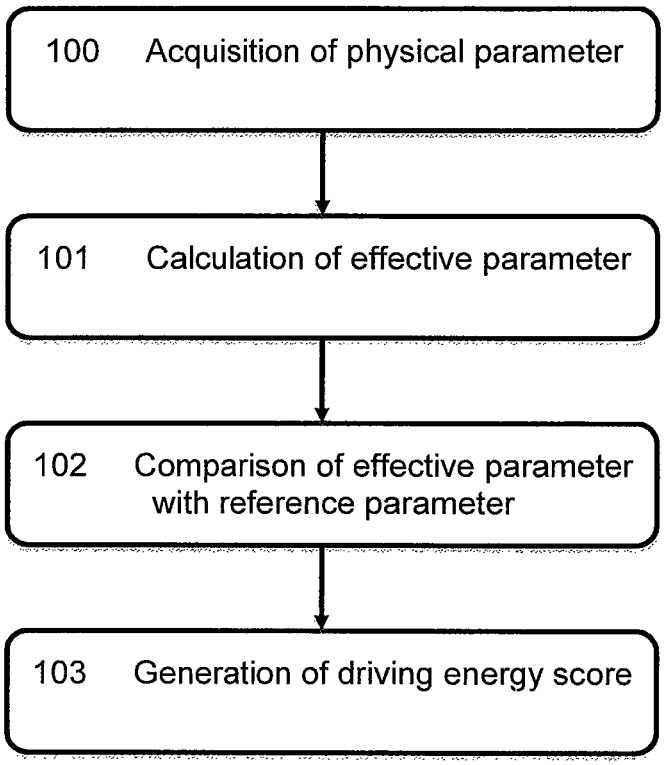
FIG. 1 schematically represents the key steps in the driving evaluation process according to the invention.
Figure 2:
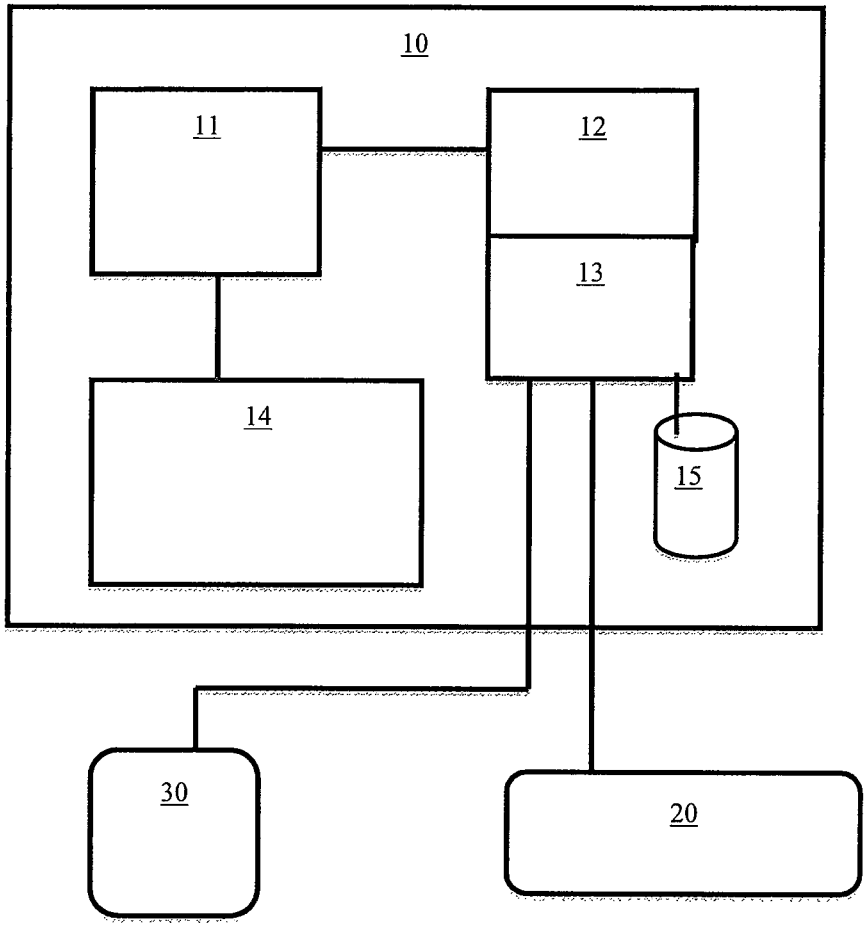
FIG. 2 is an example of a vehicle driving evaluation device according to the invention.
Figure 3:
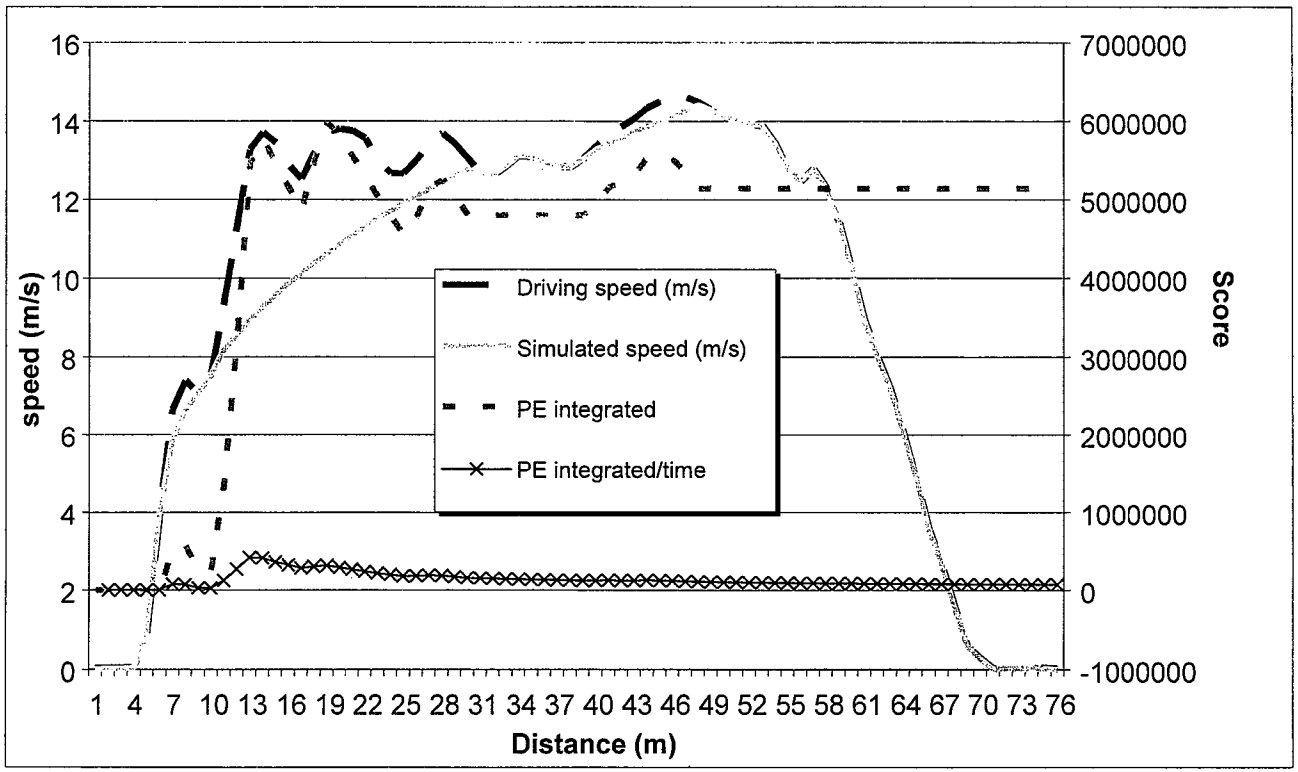
FIGS. 3 and 4 present examples of results obtained using the process and the device presented.

FIG. 2 illustrates an example of a device 10 for evaluating driving according to the invention. Means 11 to obtain at least one physical parameter is provided whereby it is possible to receive or obtain one or more parameters such as speed, acceleration, location at any given time, etc. These parameters may be obtained either directly, or through one or more sensors or devices able to supply such data. In the first case the means can comprise one or more sensors such as accelerometers. In the second case it can be connected to external equipment or sensors or to an external or internal geopositioning system such as that described below.

A calculation and comparison unit 12 can calculate, from a physical parameter, an effective parameter that depends on instantaneous acceleration, and then compare this effective parameter with a reference parameter. This calculation and comparison unit comprises physical means and (or) appropriate calculation instructions. The calculation and comparison unit 12 is linked to the means to obtain a physical parameter 11 to enable the transmission of the data to the unit 12.

A driving evaluation (or driving energy evaluation) unit 13 generates a vehicle driving energy score (or driving score). To do this, the evaluation unit 13 measures the variance between the effective parameter and one or more reference parameters.

The driving evaluation unit 13 comprises the physical means and (or) appropriate calculation instructions. It is advantageously linked to the calculation and comparison unit 12 to enable the transmission of data. A database 15 containing reference parameters is also provided. This database may be integrated into the device, as shown in FIG. 2, or else be remotely located and accessible by the evaluation unit 13.

The score obtained can take the form of an instantaneous value or else an average or integrated value for a given journey or portion thereof.

A geopositioning system 14 such as the global navigation satellite system GPS (Global Positioning System) can be provided to supply a physical parameter, in particular the geographical location of the vehicle. This location can enable the means to obtain physical parameters 11 to determine the speed, acceleration, etc. The antenna of the geopositioning system can be internal or placed outside the vehicle to facilitate the reception of signals such as those from the GPS satellite network or other network.

A means of display 20, advantageously provided in the vehicle driver's field of vision can also be provided to allow certain evaluation results that are of use to the driver to be displayed. Based on these results, the driver can decide whether or not to modify or change driving style, e.g. to try and obtain more favorable results.

The device can also include means to identify the driver, e.g. a radiofrequency identification (RFID) card or any similar means.

An external interface 30, either wired or wireless, can also be provided. Such an interface makes it possible to transmit certain data and (or) results to an external device such as a computer, which can process the data for the vehicle or for a fleet of vehicles. The data or results can be transmitted in real time, e.g. by cell telephony or any other remote means of communication, or when the vehicle has come back to its management base, by which is meant the usual place where the vehicle is parked when not in use and (or) where its management and (or) inspection and (or) maintenance are carried out. The data transmitted can be of any type, such as times of start and end of travel, the vehicle and (or) driver identifier, in addition to basic data and the results delivered by the process. A management unit can in addition monitor one or more drivers and (or) vehicles, or compare different vehicles and (or) drivers, etc.

FIG. 2 illustrates the main steps in the process of vehicle driving evaluation according to the invention. In step 100, one or more physical parameters are obtained by the means for obtaining physical parameters 11. One or more effective parameters is (are) calculated in step 101 by the calculation and comparison unit 12. Then in step 102 the same unit makes a comparison of the established effective parameter or parameters with one or more reference parameters. In step 103, a score describing how economically the vehicle is being driven is generated by the driving evaluation unit 13. This score can be used to present to the driver one or more indications stating whether the driver's style of driving is favorable in relation to economy driving criteria. The driver may then change driving style if necessary to improve economy driving performance.

The results and, if required, the initial data such as the physical parameters can also be transmitted to a data management unit processing the data for the vehicle concerned either individually or as part of the management of a fleet of vehicles.

Table 1a below presents an example of a calculation performed based on an energy mode. Other modes of calculation can be used, e.g. an acceleration mode, illustrated further on in Table 2.

TABLE 1a

Theoretical example based on energy.

| GPS coordinates | | | V | | A | | | | Instantaneous | |
|---|---|---|---|---|---|---|---|---|---|---|
| Long | Lat | Alt | vehicle | P eff | veh | A ref | V ref | P ref | score | Cumulated score |
| L1 | I1 | A1 | | | Y1 | Yr1 | | | | |
| L2 | I2 | A2 | V1 | Pe1 | Y2 | Yr2 | Vr1 | Pr1 | Ci1 = Pe1 − Pr1 | Cc1 = Ci1.dt1 |
| L3 | I3 | A3 | V2 | Pe2 | Y3 | Yr3 | Vr2 | Pr2 | Ci2 = Pe2 − Pr2 | Cc2 = Cc1 + Ci2 × dt2 |
| L4 | I4 | A4 | V3 | Pe3 | Y4 | Yr4 | Vr3 | Pr3 | Qi3 = Pe3 − Pr3 | Cc3 = Cc2 + Ci3 × dt3 |
| ... | ... | ... | ... | ... | ... | ... | ... | ... | | ... |

From the physical parameter corresponding to the geopositioning coordinates, i.e. latitude, longitude and possibly altitude, obtained by a geopositioning device 14, a physical parameter, in this case the vehicle speed, is determined. To do this, at time t1 the geopositioning coordinates are obtained from the geopositioning system 14. The metric coordinates of the route (X1, Y1, Z1) are established. At time t2 the new geopositioning coordinates are obtained. The new metric coordinates of the route (X2, Y2, Z2) are established. Using the distance traveled between the first coordinates and these new ones, the speed of the traveling vehicle V1 can be determined.

This step can be preferentially achieved by the calculation and comparison unit 12, which then determines an effective parameter Peff.

In this example based on energy, the effective parameter Peff is determined by the following relation:

$$P_{eff} = \frac{1}{2}m(v_{i+1}^2 - v_i^2).$$

In this example, the effective parameter is counted only if its sign is positive. If it is negative, it is assigned a value of nil (non-recovery of energy on braking).

If the vehicle is fitted with a braking energy recovery system it is possible to apply a weighting coefficient, e.g. of about 0.15, during braking phases.

In a variant the absolute value of the effective parameter is used to take into account the energy dissipated during braking phases.

In addition, in the calculation of Peff it is possible to integrate:

- A coefficient proportional to the cube of the vehicle speed, or to a more complex polynomial function thereof, to take into account the aerodynamic component of energy expenditure;
- A coefficient proportional to the speed to allow in particular for viscous friction, e.g. due to gearbox lubricant;
- A coefficient proportional to speed and acceleration to take into account transmission friction proportional to torque;
- A coefficient proportional to the local incline to take into account the potential energy effect thereof.

Other criteria can also be applied, not only based simply on inertial energy, but also taking into account other parameters such as the rolling resistance of tires, for which the law is generally fairly constant up to a speed threshold, which depends on the tire, beyond which it rapidly increases, and any other resistance factor slowing the movement of the vehicle.

From the route coordinates (X1, Y1, Z1) and (X2, Y2, Z2) and the speed V1, the reference speed Vr1 of the vehicle is calculated. In this example, to calculate this speed, the following approach is taken: in the acceleration phase, on the same spatial abscissa, the simulator uses a speed increment defined by two criteria:

- The acceleration may not be greater than a maximum acceleration that depends on the current speed range. This maximum acceleration is taken from a table of maximum accelerations per speed range that specifies a favorable driving style. Table 1c presents a concise example of such a table.
- If this last acceleration yields a simulator speed greater than that of the real vehicle, then the acceleration taken is that separating the simulator speed from that of the vehicle.

This approach is also applied in the braking phase, where the first function becomes inoperative, the acceleration being negative, and the second function alone handles the decreasing speed pattern.

Other embodiments are also possible, in particular using the detection of speed troughs (speed points flanked by higher values). From these speed troughs, the possible acceleration at each point is determined following a principle similar to the preceding one in acceleration phases along the time line, and back calculating for braking phases. In this way an acceleration curve is obtained whereby it is possible to deduce the speed until it meets the next upcoming braking curve.

It is also possible to cut off peak speeds in advance of braking phases, i.e. to anticipate braking phases.

It is also possible, in order to optimize the resolution of the simulator, to take into account the transverse acceleration to make a weighting in a bend. Lastly, it is possible to take into account the local incline along the route.

From the location characteristics and the speed Vr1, the reference parameter (or simulator economy driving rating) Pr1 is calculated for the vehicle as above.

By comparison of the parameters Peff and Pr (in this example by subtraction, but in other examples the ratio can also be used), the instantaneous score Ci1 (or driving energy score) is calculated. By summing or integration over the whole journey, the cumulated or overall score (or economy driving rating) Ci is determined.

A similar procedure is applied for the other points along the travel route.

Figure 4:
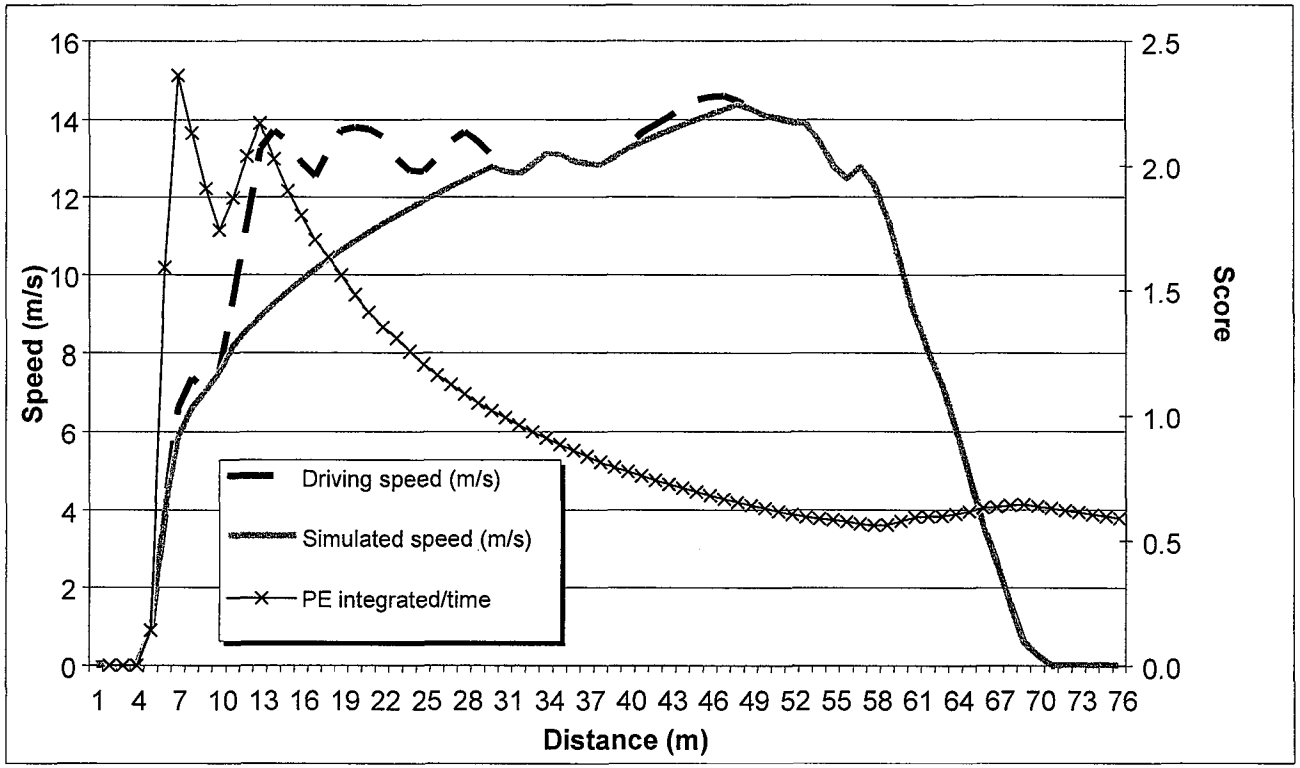

The following table (Table 1b) illustrates an example of application over a deliberately very short test route. FIG. 4 graphically illustrates the data and results obtained for this test route.

TABLE 1b

Numerical example (based on energy).

| lat (°) | long (°) | alt (m) | V veh (m/s) | Pe | A veh | A ref | V ref (m/s) | Pref | Inst. Score | Integrated score | Integrated score/ time |
|---|---|---|---|---|---|---|---|---|---|---|---|
| 4546.0 | 306.4 | 388.7 | 0.0 | 0.0 | | 0.0 | 0.0 | 0.0 | 0.0 | 0.0 | |
| 4546.0 | 306.4 | 388.7 | 0.0 | 0.0 | 0.0 | 0.0 | 0.0 | 51.4 | −51.4 | −51.4 | −25.7 |
| 4546.0 | 306.4 | 388.8 | 0.0 | 0.0 | 0.0 | 0.0 | 0.0 | 0.0 | 0.0 | −51.4 | −17.1 |
| 4546.0 | 306.4 | 388.8 | 0.0 | 40.0 | 0.0 | 0.0 | 0.0 | 40.0 | 0.0 | −51.4 | −12.9 |
| 4546.0 | 306.4 | 388.8 | 0.9 | 44140.3 | 0.9 | 0.0 | 0.9 | 44140.3 | 0.0 | −51.4 | −10.3 |
| 4546.0 | 306.4 | 388.9 | 4.0 | 804591.8 | 3.1 | 0.1 | 4.0 | 804591.8 | 0.0 | −51.4 | −8.6 |
| 4546.0 | 306.4 | 389.0 | 6.6 | 1534778.2 | 2.7 | 0.0 | 5.9 | 1011005.0 | 523773.2 | 523721.8 | 74817.4 |
| 4546.0 | 306.4 | 389.1 | 7.4 | 560938.8 | 0.7 | 0.0 | 6.6 | 518683.8 | 42255.0 | 565976.8 | 70747.1 |
| 4546.0 | 306.4 | 389.3 | 7.1 | 0.0 | −0.3 | 0.0 | 7.1 | 309411.0 | −309411.0 | 256565.8 | 28507.3 |
| 4546.0 | 306.4 | 389.4 | 7.6 | 389312.4 | 0.5 | 0.0 | 7.6 | 389312.4 | 0.0 | 256565.8 | 25656.6 |
| 4546.0 | 306.4 | 389.5 | 9.3 | 1631890.6 | 1.8 | 0.0 | 8.2 | 530393.2 | 1101497.4 | 1358063.2 | 123460.3 |
| 4546.0 | 306.4 | 389.6 | 11.3 | 2214654.1 | 2.0 | 0.0 | 8.6 | 358008.8 | 1856645.3 | 3214708.5 | 267892.4 |
| 4546.0 | 306.4 | 389.8 | 13.3 | 2588500.5 | 1.9 | 0.0 | 8.9 | 340398.0 | 2248102.5 | 5462811.0 | 420216.2 |
| 4546.0 | 306.4 | 389.9 | 13.7 | 629239.9 | 0.4 | 0.0 | 9.3 | 325885.2 | 303354.7 | 5766165.7 | 411869.0 |
| 4546.0 | 306.4 | 389.9 | 13.4 | 0.0 | −0.3 | 0.0 | 9.6 | 313618.1 | −313618.1 | 5452547.6 | 363503.2 |
| 4546.0 | 306.4 | 390.0 | 12.9 | 0.0 | −0.6 | 0.0 | 9.9 | 303046.1 | −303046.1 | 5149501.5 | 321843.8 |
| 4546.0 | 306.4 | 390.1 | 12.5 | 0.0 | −0.4 | 0.0 | 10.1 | 293794.0 | −293794.0 | 4855707.5 | 285629.9 |
| 4546.0 | 306.4 | 390.1 | 13.2 | 943191.5 | 0.7 | 0.0 | 10.4 | 285595.8 | 657595.7 | 5513303.2 | 306294.6 |
| 4546.0 | 306.3 | 390.3 | 13.7 | 740049.1 | 0.5 | 0.0 | 10.6 | 278256.2 | 461792.9 | 5975096.1 | 314478.7 |
| 4546.0 | 306.3 | 390.4 | 13.8 | 114570.4 | 0.1 | 0.0 | 10.9 | 271628.2 | −157057.8 | 5818038.4 | 290901.9 |
| 4546.0 | 306.3 | 390.4 | 13.8 | 0.0 | 0.0 | 0.0 | 11.1 | 265598.3 | −265598.3 | 5552440.1 | 264401.9 |
| 4546.0 | 306.3 | 390.6 | 13.6 | 0.0 | −0.2 | 0.0 | 11.3 | 260077.4 | −260077.4 | 5292362.7 | 240561.9 |
| 4546.0 | 306.3 | 390.8 | 13.0 | 0.0 | −0.6 | 0.0 | 11.5 | 254994.3 | −254994.3 | 5037368.4 | 219016.0 |
| 4546.0 | 306.3 | 391.0 | 12.7 | 0.0 | −0.3 | 0.0 | 11.7 | 250291.3 | −250291.3 | 4787077.1 | 199461.5 |
| 4545.9 | 306.3 | 391.4 | 12.7 | 0.0 | 0.0 | 0.0 | 11.9 | 245921.0 | −245921.0 | 4541156.1 | 181646.2 |
| 4545.9 | 306.3 | 391.8 | 13.0 | 477688.8 | 0.3 | 0.0 | 12.1 | 241844.0 | 235844.7 | 4777000.9 | 183730.8 |
| 4545.9 | 306.3 | 392.3 | 13.4 | 617005.3 | 0.4 | 0.0 | 12.3 | 238027.4 | 378977.9 | 5155978.7 | 190962.2 |
| 4545.9 | 306.3 | 392.7 | 13.7 | 338827.7 | 0.2 | 0.0 | 12.5 | 234443.2 | 104384.5 | 5260363.2 | 187870.1 |

TABLE 1b-continued

Numerical example (based on energy).

| lat (°) | long (°) | alt (m) | V veh (m/s) | Pe | A veh | A ref | V ref (m/s) | Pref | Inst. Score | Integrated score | Integrated score/ time |
|---|---|---|---|---|---|---|---|---|---|---|---|
| 4545.9 | 306.3 | 393.3 | 13.4 | 0.0 | −0.3 | 0.0 | 12.6 | 231067.7 | −231067.7 | 5029295.6 | 173424.0 |
| 4545.9 | 306.2 | 393.5 | 13.1 | 0.0 | −0.3 | 0.0 | 12.8 | 227880.3 | −227880.3 | 4801415.3 | 160047.2 |
| 4545.9 | 306.2 | 393.8 | 12.6 | 0.0 | −0.4 | 0.0 | 12.6 | 0.0 | 0.0 | 4801415.3 | 154884.4 |
| 4545.9 | 306.2 | 394.1 | 12.6 | 0.0 | 0.0 | 0.0 | 12.6 | 0.0 | 0.0 | 4801415.3 | 150044.2 |
| 4545.9 | 306.2 | 394.4 | 12.9 | 339551.7 | 0.2 | 0.0 | 12.9 | 339551.7 | 0.0 | 4801415.3 | 145497.4 |
| 4545.9 | 306.2 | 394.8 | 13.1 | 367983.3 | 0.3 | 0.0 | 13.1 | 367983.3 | 0.0 | 4801415.3 | 141218.1 |
| 4545.9 | 306.2 | 395.0 | 13.1 | 0.0 | 0.0 | 0.0 | 13.1 | 0.0 | 0.0 | 4801415.3 | 137183.3 |
| 4545.9 | 306.2 | 395.1 | 12.9 | 0.0 | −0.2 | 0.0 | 12.9 | 0.0 | 0.0 | 4801415.3 | 133372.6 |
| 4545.9 | 306.2 | 395.1 | 12.9 | 0.0 | −0.1 | 0.0 | 12.9 | 0.0 | 0.0 | 4801415.3 | 129768.0 |
| 4545.9 | 306.2 | 395.0 | 12.8 | 0.0 | 0.0 | 0.0 | 12.8 | 0.0 | 0.0 | 4801415.3 | 126353.0 |
| 4545.9 | 306.2 | 394.9 | 13.0 | 280285.2 | 0.2 | 0.0 | 13.0 | 280285.2 | 0.0 | 4801415.3 | 123113.2 |
| 4545.9 | 306.2 | 394.9 | 13.4 | 447105.2 | 0.3 | 0.0 | 13.3 | 316809.8 | 130295.4 | 4931710.7 | 123292.8 |
| 4545.9 | 306.2 | 394.9 | 13.7 | 434972.1 | 0.3 | 0.0 | 13.4 | 216619.1 | 218353.0 | 5150063.7 | 125611.3 |
| 4545.9 | 306.1 | 394.9 | 13.9 | 297883.1 | 0.2 | 0.0 | 13.6 | 214150.8 | 83732.3 | 5233796.1 | 124614.2 |
| 4545.9 | 306.1 | 394.8 | 14.1 | 310033.4 | 0.2 | 0.0 | 13.7 | 211792.1 | 98241.3 | 5332037.4 | 124000.9 |
| 4545.9 | 306.1 | 394.7 | 14.3 | 409874.7 | 0.3 | 0.0 | 13.9 | 209534.8 | 200339.9 | 5532377.3 | 125735.8 |
| 4545.9 | 306.1 | 394.6 | 14.5 | 256068.9 | 0.2 | 0.0 | 14.0 | 207371.4 | 48697.5 | 5581074.8 | 124023.9 |
| 4545.9 | 306.1 | 394.7 | 14.6 | 137226.1 | 0.1 | 0.0 | 14.1 | 205295.3 | −68069.2 | 5513005.5 | 119847.9 |
| 4545.9 | 306.1 | 394.7 | 14.6 | 32408.4 | 0.0 | 0.0 | 14.3 | 203300.5 | −170892.0 | 5342113.5 | 113662.0 |
| 4545.9 | 306.1 | 394.9 | 14.5 | 0.0 | −0.1 | 0.0 | 14.4 | 201381.5 | −201381.5 | 5140732.0 | 107098.6 |
| 4545.9 | 306.1 | 395.0 | 14.3 | 0.0 | −0.2 | 0.0 | 14.3 | 0.0 | 0.0 | 5140732.0 | 104912.9 |
| 4545.8 | 306.1 | 395.1 | 14.1 | 0.0 | −0.2 | 0.0 | 14.1 | 0.0 | 0.0 | 5140732.0 | 102814.6 |
| 4545.8 | 306.1 | 395.3 | 14.0 | 0.0 | −0.1 | 0.0 | 14.0 | 0.0 | 0.0 | 5140732.0 | 100798.7 |
| 4545.8 | 306.1 | 395.5 | 13.9 | 0.0 | −0.1 | 0.0 | 13.9 | 0.0 | 0.0 | 5140732.0 | 98860.2 |
| 4545.8 | 306.0 | 395.6 | 13.9 | 0.0 | −0.1 | 0.0 | 13.9 | 0.0 | 0.0 | 5140732.0 | 96994.9 |
| 4545.8 | 306.0 | 395.9 | 13.4 | 0.0 | −0.5 | 0.0 | 13.4 | 0.0 | 0.0 | 5140732.0 | 95198.7 |
| 4545.8 | 306.0 | 396.0 | 12.8 | 0.0 | −0.6 | 0.0 | 12.8 | 0.0 | 0.0 | 5140732.0 | 93467.9 |
| 4545.8 | 306.0 | 396.2 | 12.5 | 0.0 | −0.3 | 0.0 | 12.5 | 0.0 | 0.0 | 5140732.0 | 91798.8 |
| 4545.8 | 306.0 | 396.4 | 12.8 | 441613.4 | 0.3 | 0.0 | 12.8 | 441613.4 | 0.0 | 5140732.0 | 90188.3 |
| 4545.8 | 306.0 | 396.7 | 12.3 | 0.0 | −0.5 | 0.0 | 12.3 | 0.0 | 0.0 | 5140732.0 | 88633.3 |
| 4545.8 | 306.0 | 396.9 | 11.4 | 0.0 | −0.9 | 0.0 | 11.4 | 0.0 | 0.0 | 5140732.0 | 87131.1 |
| 4545.8 | 306.0 | 397.0 | 10.2 | 0.0 | −1.2 | 0.0 | 10.2 | 0.0 | 0.0 | 5140732.0 | 85678.9 |
| 4545.8 | 306.0 | 397.2 | 8.9 | 0.0 | −1.3 | 0.0 | 8.9 | 0.0 | 0.0 | 5140732.0 | 84274.3 |
| 4545.8 | 306.0 | 397.3 | 8.0 | 0.0 | −0.9 | 0.0 | 8.0 | 0.0 | 0.0 | 5140732.0 | 82915.0 |
| 4545.8 | 306.0 | 397.4 | 7.2 | 0.0 | −0.8 | 0.0 | 7.2 | 0.0 | 0.0 | 5140732.0 | 81598.9 |
| 4545.8 | 306.0 | 397.8 | 6.1 | 0.0 | −1.1 | 0.0 | 6.1 | 0.0 | 0.0 | 5140732.0 | 80323.9 |
| 4545.8 | 306.0 | 397.7 | 4.9 | 0.0 | −1.2 | 0.0 | 4.9 | 0.0 | 0.0 | 5140732.0 | 79088.2 |
| 4545.8 | 306.0 | 397.7 | 3.6 | 0.0 | −1.3 | 0.0 | 3.6 | 0.0 | 0.0 | 5140732.0 | 77889.9 |
| 4545.8 | 306.0 | 397.7 | 2.6 | 0.0 | −0.9 | 0.0 | 2.6 | 0.0 | 0.0 | 5140732.0 | 76727.3 |
| 4545.8 | 306.0 | 397.6 | 1.6 | 0.0 | −1.1 | 0.0 | 1.6 | 0.0 | 0.0 | 5140732.0 | 75599.0 |
| 4545.8 | 306.0 | 397.6 | 0.6 | 0.0 | −1.0 | 0.0 | 0.6 | 0.0 | 0.0 | 5140732.0 | 74503.4 |
| 4545.8 | 306.0 | 397.5 | 0.3 | 0.0 | −0.3 | 0.0 | 0.3 | 0.0 | 0.0 | 5140732.0 | 73439.0 |
| 4545.8 | 306.0 | 397.4 | 0.0 | 0.0 | −0.3 | 0.0 | 0.0 | 0.0 | 0.0 | 5140732.0 | 72404.7 |
| 4545.8 | 306.0 | 397.3 | 0.0 | 22.8 | 0.0 | 0.0 | 0.0 | 22.8 | 0.0 | 5140732.0 | 71399.1 |
| 4545.8 | 306.0 | 397.2 | 0.0 | 0.0 | 0.0 | 0.0 | 0.0 | 0.0 | 0.0 | 5140732.0 | 70421.0 |
| 4545.8 | 306.0 | 397.1 | 0.0 | 0.0 | 0.0 | 0.0 | 0.0 | 0.0 | 0.0 | 5140732.0 | 69469.4 |
| 4545.8 | 306.0 | 397.0 | 0.0 | 12.9 | 0.0 | 0.0 | 0.0 | 12.9 | 0.0 | 5140732.0 | 68543.1 |
| 4545.8 | 306.0 | 397.0 | 0.0 | 0.0 | 0.0 | 0.0 | 0.0 | 0.0 | 0.0 | 5140732.0 | 67641.2 |

TABLE 1c

Maximum accelerations per speed range.

| | | Maximum acceleration (G) |
|---|---|---|
| Speed range (upper limit in km/h) | 2.5 | 1.30 |
| | 7.5 | 1.20 |
| | 12.5 | 1.10 |
| | 17.5 | 1.03 |
| | 22.5 | 0.95 |
| | 27.5 | 0.88 |
| | 32.5 | 0.80 |
| | 37.5 | 0.75 |
| | 42.5 | 0.70 |
| | 47.5 | 0.65 |
| | 52.5 | 0.60 |
| | 57.5 | 0.55 |
| | 62.5 | 0.50 |
| | 67.5 | 0.48 |

TABLE 1c-continued

Maximum accelerations per speed range.

| | Maximum acceleration (G) |
|---|---|
| 72.5 | 0.45 |
| 77.5 | 0.42 |
| 82.5 | 0.40 |
| 87.5 | 0.37 |
| 92.5 | 0.35 |

In another example of implementation presented in Table 2a below, the effective parameter used is the instantaneous acceleration measured directly with accelerometers. According to diverse variants, the acceleration is calculated from the speed measured or obtained from the vehicle, e.g. via the vehicle bus or from geographical location information obtained for example from a geopositioning system. The reference parameter can also be a reference acceleration, either fixed or preferentially specified in a multiple-entry table. These entries can if necessary comprise the preceding reference speed, the local incline, the radius of the road bend or route followed, the distance and (or) the time from the next real speed trough (projected calculation), or the mass of the vehicle. An example of an application in which the effective parameter is the actual acceleration of the vehicle and the reference parameter is the simulated acceleration is shown below in Table 2b. FIG. 4 graphically illustrates these results.

In this example of an embodiment, the reference parameter is based on an acceleration table that depends on the previous speed, the reference parameter and the road incline.

For the driving energy score, the difference between the effective and reference parameters is used. To enhance the variance between the effective parameter representative of the actual driving and the reference parameter representing the ideal driving, and to take into account the energy dissipated during braking phases, the instantaneous score Ci is here the square of the difference.

TABLE 2a

Theoretical example based on instantaneous acceleration.

| GPS coordinates | | | V | A | | | | | Instantaneous | |
|---|---|---|---|---|---|---|---|---|---|---|
| Long | Lat | Alt | veh | veh | P eff | V ref | A ref | P ref | score | Cumulated score |
| L1 | I1 | A1 | | | | | | | | |
| L2 | I2 | A2 | V1 | | | Vr1 | | | | |
| L3 | I3 | A3 | V2 | Y1 | Pe1 = Y1 | Vr2 | Yr1 | Pr1 = Yr1 | Ci1 = (Pe1 − Pr1)$^2$ | Cc1 = Ci1.dt1 |
| L4 | I4 | A4 | V3 | Y2 | Pe2 = Y2 | Vr3 | Yr2 | Pr2 = Yr2 | Ci2 = (Pe2 − Pr2)$^2$ | Cc2 = Cc1 + Ci2 × dt2 |
| . . . | . . . | . . . | . . . | . . . | . . . | . . . | . . . | . . . | | . . . |

TABLE 2b

Numerical example (based on acceleration)

| lat (°) | long (°) | alt (m) | V veh (m/s) | A veh | Pe | V Ref (m/s) | A ref | Pref | Inst score | Integrated score | Integrated score/ time |
|---|---|---|---|---|---|---|---|---|---|---|---|
| 4546.0 | 306.4 | 388.7 | 0.0 | | 0.0000 | 0.0 | 0.0000 | 0.0000 | 0.000 | 0.0 | |
| 4546.0 | 306.4 | 388.7 | 0.0 | 0.0000 | 0.0000 | 0.0 | 0.0000 | 0.0000 | 0.000 | 0.0 | 0.0 |
| 4546.0 | 306.4 | 388.8 | 0.0 | 0.0000 | 0.0000 | 0.0 | 0.0000 | 0.0000 | 0.000 | 0.0 | 0.0 |
| 4546.0 | 306.4 | 388.8 | 0.0 | 0.0103 | 0.0103 | 0.0 | 0.0003 | 0.0003 | 0.000 | 0.0 | 0.0 |
| 4546.0 | 306.4 | 388.8 | 0.9 | 0.8643 | 0.8643 | 0.9 | 0.0245 | 0.0245 | 0.705 | 0.7 | 0.1 |
| 4546.0 | 306.4 | 388.9 | 4.0 | 3.0609 | 3.0609 | 4.0 | 0.0867 | 0.0867 | 8.846 | 9.6 | 1.6 |
| 4546.0 | 306.4 | 389.0 | 6.6 | 2.6803 | 2.6803 | 5.9 | 0.0348 | 0.0348 | 6.998 | 16.6 | 2.4 |
| 4546.0 | 306.4 | 389.1 | 7.4 | 0.7408 | 0.7408 | 6.6 | 0.0218 | 0.0218 | 0.517 | 17.1 | 2.1 |
| 4546.0 | 306.4 | 389.3 | 7.1 | −0.3292 | −0.3292 | 7.1 | 0.0170 | 0.0170 | 0.120 | 17.2 | 1.9 |
| 4546.0 | 306.4 | 389.4 | 7.6 | 0.4939 | 0.4939 | 7.6 | 0.0140 | 0.0140 | 0.230 | 17.4 | 1.7 |
| 4546.0 | 306.4 | 389.5 | 9.3 | 1.7903 | 1.7903 | 8.2 | 0.0125 | 0.0125 | 3.160 | 20.6 | 1.9 |
| 4546.0 | 306.4 | 389.6 | 11.3 | 1.9858 | 1.9858 | 8.6 | 0.0112 | 0.0112 | 3.899 | 24.5 | 2.0 |
| 4546.0 | 306.4 | 389.8 | 13.3 | 1.9497 | 1.9497 | 8.9 | 0.0102 | 0.0102 | 3.762 | 28.2 | 2.2 |
| 4546.0 | 306.4 | 389.9 | 13.7 | 0.4321 | 0.4321 | 9.3 | 0.0094 | 0.0094 | 0.179 | 28.4 | 2.0 |
| 4546.0 | 306.4 | 389.9 | 13.4 | −0.2675 | −0.2675 | 9.6 | 0.0087 | 0.0087 | 0.076 | 28.5 | 1.9 |
| 4546.0 | 306.4 | 390.0 | 12.9 | −0.5556 | −0.5556 | 9.9 | 0.0082 | 0.0082 | 0.318 | 28.8 | 1.8 |
| 4546.0 | 306.4 | 390.1 | 12.5 | −0.3550 | −0.3550 | 10.1 | 0.0077 | 0.0077 | 0.132 | 28.9 | 1.7 |
| 4546.0 | 306.4 | 390.1 | 13.2 | 0.6791 | 0.6791 | 10.4 | 0.0073 | 0.0073 | 0.451 | 29.4 | 1.6 |
| 4546.0 | 306.3 | 390.3 | 13.7 | 0.5093 | 0.5093 | 10.6 | 0.0069 | 0.0069 | 0.252 | 29.6 | 1.6 |
| 4546.0 | 306.3 | 390.4 | 13.8 | 0.0772 | 0.0772 | 10.9 | 0.0066 | 0.0066 | 0.005 | 29.7 | 1.5 |
| 4546.0 | 306.3 | 390.4 | 13.8 | −0.0463 | −0.0463 | 11.1 | 0.0063 | 0.0063 | 0.003 | 29.7 | 1.4 |
| 4546.0 | 306.3 | 390.6 | 13.6 | −0.1903 | −0.1903 | 11.3 | 0.0061 | 0.0061 | 0.039 | 29.7 | 1.3 |
| 4546.0 | 306.3 | 390.8 | 13.0 | −0.5659 | −0.5659 | 11.5 | 0.0059 | 0.0059 | 0.327 | 30.0 | 1.3 |
| 4546.0 | 306.3 | 391.0 | 12.7 | −0.3138 | −0.3138 | 11.7 | 0.0057 | 0.0057 | 0.102 | 30.1 | 1.3 |
| 4545.9 | 306.3 | 391.4 | 12.7 | −0.0103 | −0.0103 | 11.9 | 0.0055 | 0.0055 | 0.000 | 30.1 | 1.2 |
| 4545.9 | 306.3 | 391.8 | 13.0 | 0.3447 | 0.3447 | 12.1 | 0.0053 | 0.0053 | 0.115 | 30.2 | 1.2 |
| 4545.9 | 306.3 | 392.3 | 13.4 | 0.4321 | 0.4321 | 12.3 | 0.0051 | 0.0051 | 0.182 | 30.4 | 1.1 |
| 4545.9 | 306.3 | 392.7 | 13.7 | 0.2315 | 0.2315 | 12.5 | 0.0050 | 0.0050 | 0.051 | 30.5 | 1.1 |
| 4545.9 | 306.3 | 393.3 | 13.4 | −0.2624 | −0.2624 | 12.6 | 0.0048 | 0.0048 | 0.071 | 30.5 | 1.1 |
| 4545.9 | 306.2 | 393.5 | 13.1 | −0.3498 | −0.3498 | 12.8 | 0.0047 | 0.0047 | 0.126 | 30.7 | 1.0 |
| 4545.9 | 306.2 | 393.8 | 12.6 | −0.4218 | −0.4218 | 12.6 | 0.0046 | 0.0046 | 0.182 | 30.8 | 1.0 |
| 4545.9 | 306.2 | 394.1 | 12.6 | −0.0257 | −0.0257 | 12.6 | −0.0007 | −0.0007 | 0.001 | 30.9 | 1.0 |
| 4545.9 | 306.2 | 394.4 | 12.9 | 0.2469 | 0.2469 | 12.9 | 0.0045 | 0.0045 | 0.059 | 30.9 | 0.9 |
| 4545.9 | 306.2 | 394.8 | 13.1 | 0.2624 | 0.2624 | 13.1 | 0.0044 | 0.0044 | 0.067 | 31.0 | 0.9 |
| 4545.9 | 306.2 | 395.0 | 13.1 | −0.0257 | −0.0257 | 13.1 | −0.0007 | −0.0007 | 0.001 | 31.0 | 0.9 |
| 4545.9 | 306.2 | 395.1 | 12.9 | −0.1852 | −0.1852 | 12.9 | −0.0052 | −0.0052 | 0.032 | 31.0 | 0.9 |
| 4545.9 | 306.2 | 395.1 | 12.9 | −0.0669 | −0.0669 | 12.9 | −0.0019 | −0.0019 | 0.004 | 31.0 | 0.8 |
| 4545.9 | 306.2 | 395.0 | 12.8 | −0.0051 | −0.0051 | 12.8 | −0.0001 | −0.0001 | 0.000 | 31.0 | 0.8 |
| 4545.9 | 306.2 | 394.9 | 13.0 | 0.2006 | 0.2006 | 13.0 | 0.0045 | 0.0045 | 0.038 | 31.1 | 0.8 |
| 4545.9 | 306.2 | 394.9 | 13.4 | 0.3138 | 0.3138 | 13.3 | 0.0044 | 0.0044 | 0.096 | 31.1 | 0.8 |
| 4545.9 | 306.2 | 394.9 | 13.7 | 0.2984 | 0.2984 | 13.4 | 0.0043 | 0.0043 | 0.087 | 31.2 | 0.8 |
| 4545.9 | 306.1 | 394.9 | 13.9 | 0.2006 | 0.2006 | 13.6 | 0.0042 | 0.0042 | 0.039 | 31.3 | 0.7 |

TABLE 2b-continued

| Numerical example (based on acceleration) | | | | | | | | | | | |
|---|---|---|---|---|---|---|---|---|---|---|---|
| lat (°) | long (°) | alt (m) | V veh (m/s) | A veh | Pe | V Ref (m/s) | A ref | Pref | Inst score | Integrated score | Integrated score/ time |
| 4545.9 | 306.1 | 394.8 | 14.1 | 0.2058 | 0.2058 | 13.7 | 0.0041 | 0.0041 | 0.041 | 31.3 | 0.7 |
| 4545.9 | 306.1 | 394.7 | 14.3 | 0.2675 | 0.2675 | 13.9 | 0.0040 | 0.0040 | 0.069 | 31.4 | 0.7 |
| 4545.9 | 306.1 | 394.6 | 14.5 | 0.1646 | 0.1646 | 14.0 | 0.0039 | 0.0039 | 0.026 | 31.4 | 0.7 |
| 4545.9 | 306.1 | 394.7 | 14.6 | 0.0875 | 0.0875 | 14.1 | 0.0038 | 0.0038 | 0.007 | 31.4 | 0.7 |
| 4545.9 | 306.1 | 394.7 | 14.6 | 0.0206 | 0.0206 | 14.3 | 0.0038 | 0.0038 | 0.000 | 31.4 | 0.7 |
| 4545.9 | 306.1 | 394.9 | 14.5 | −0.1286 | −0.1286 | 14.4 | 0.0037 | 0.0037 | 0.018 | 31.4 | 0.7 |
| 4545.9 | 306.1 | 395.0 | 14.3 | −0.2006 | −0.2006 | 14.3 | 0.0036 | 0.0036 | 0.042 | 31.5 | 0.6 |
| 4545.8 | 306.1 | 395.1 | 14.1 | −0.1749 | −0.1749 | 14.1 | −0.0050 | −0.0050 | 0.029 | 31.5 | 0.6 |
| 4545.8 | 306.1 | 395.3 | 14.0 | −0.0875 | −0.0875 | 14.0 | −0.0025 | −0.0025 | 0.007 | 31.5 | 0.6 |
| 4545.8 | 306.1 | 395.5 | 13.9 | −0.0772 | −0.0772 | 13.9 | −0.0022 | −0.0022 | 0.006 | 31.5 | 0.6 |
| 4545.8 | 306.0 | 395.6 | 13.9 | −0.0566 | −0.0566 | 13.9 | −0.0016 | −0.0016 | 0.003 | 31.5 | 0.6 |
| 4545.8 | 306.0 | 395.9 | 13.4 | −0.4579 | −0.4579 | 13.4 | −0.0130 | −0.0130 | 0.198 | 31.7 | 0.6 |
| 4545.8 | 306.0 | 396.0 | 12.8 | −0.6431 | −0.6431 | 12.8 | −0.0182 | −0.0182 | 0.390 | 32.1 | 0.6 |
| 4545.8 | 306.0 | 396.2 | 12.5 | −0.3138 | −0.3138 | 12.5 | −0.0089 | −0.0089 | 0.093 | 32.2 | 0.6 |
| 4545.8 | 306.0 | 396.4 | 12.8 | 0.3241 | 0.3241 | 12.8 | 0.0046 | 0.0046 | 0.102 | 32.3 | 0.6 |
| 4545.8 | 306.0 | 396.7 | 12.3 | −0.4784 | −0.4784 | 12.3 | −0.0135 | −0.0135 | 0.216 | 32.5 | 0.6 |
| 4545.8 | 306.0 | 396.9 | 11.4 | −0.8797 | −0.8797 | 11.4 | −0.0249 | −0.0249 | 0.731 | 33.2 | 0.6 |
| 4545.8 | 306.0 | 397.0 | 10.2 | −1.2244 | −1.2244 | 10.2 | −0.0347 | −0.0347 | 1.415 | 34.7 | 0.6 |
| 4545.8 | 306.0 | 397.2 | 8.9 | −1.2707 | −1.2707 | 8.9 | −0.0360 | −0.0360 | 1.524 | 36.2 | 0.6 |
| 4545.8 | 306.0 | 397.3 | 8.0 | −0.9414 | −0.9414 | 8.0 | −0.0267 | −0.0267 | 0.837 | 37.0 | 0.6 |
| 4545.8 | 306.0 | 397.4 | 7.2 | −0.8077 | −0.8077 | 7.2 | −0.0229 | −0.0229 | 0.616 | 37.6 | 0.6 |
| 4545.8 | 306.0 | 397.8 | 6.1 | −1.1112 | −1.1112 | 6.1 | −0.0315 | −0.0315 | 1.166 | 38.8 | 0.6 |
| 4545.8 | 306.0 | 397.7 | 4.9 | −1.1678 | −1.1678 | 4.9 | −0.0331 | −0.0331 | 1.288 | 40.1 | 0.6 |
| 4545.8 | 306.0 | 397.7 | 3.6 | −1.3324 | −1.3324 | 3.6 | −0.0377 | −0.0377 | 1.676 | 41.8 | 0.6 |
| 4545.8 | 306.0 | 397.7 | 2.6 | −0.9363 | −0.9363 | 2.6 | −0.0265 | −0.0265 | 0.828 | 42.6 | 0.6 |
| 4545.8 | 306.0 | 397.6 | 1.6 | −1.0598 | −1.0598 | 1.6 | −0.0300 | −0.0300 | 1.060 | 43.7 | 0.6 |
| 4545.8 | 306.0 | 397.6 | 0.6 | −0.9980 | −0.9980 | 0.6 | −0.0283 | −0.0283 | 0.940 | 44.6 | 0.6 |
| 4545.8 | 306.0 | 397.5 | 0.3 | −0.3035 | −0.3035 | 0.3 | −0.0086 | −0.0086 | 0.087 | 44.7 | 0.6 |
| 4545.8 | 306.0 | 397.4 | 0.0 | −0.2624 | −0.2624 | 0.0 | −0.0074 | −0.0074 | 0.065 | 44.8 | 0.6 |
| 4545.8 | 306.0 | 397.3 | 0.0 | 0.0103 | 0.0103 | 0.0 | 0.0003 | 0.0003 | 0.000 | 44.8 | 0.6 |
| 4545.8 | 306.0 | 397.2 | 0.0 | 0.0000 | 0.0000 | 0.0 | 0.0000 | 0.0000 | 0.000 | 44.8 | 0.6 |
| 4545.8 | 306.0 | 397.1 | 0.0 | −0.0051 | −0.0051 | 0.0 | −0.0001 | −0.0001 | 0.000 | 44.8 | 0.6 |
| 4545.8 | 306.0 | 397.0 | 0.0 | 0.0051 | 0.0051 | 0.0 | 0.0001 | 0.0001 | 0.000 | 44.8 | 0.6 |
| 4545.8 | 306.0 | 397.0 | 0.0 | −0.0051 | −0.0051 | 0.0 | 0.0000 | 0.0000 | 0.000 | 44.8 | 0.6 |

In an advantageous variant of the invention, a display device is provided that enables the driver to visualize the effect of current driving style on fuel consumption in real time. For example, the decision table presented below (Table 3) allows a score increment to be determined according to the acceleration and the speed range. In this example a display of the bar-chart type shows the score variations in real time. It can be advantageously extended by a numerical value indicating the level of the driving energy score or rational, ecological driving quality appraisal.

In this example of implementation, the value is directly used for the instantaneous display in bar-chart form, so that a value of 1 corresponds to one square, a value of 2 to 2 squares, etc. up to a value of 8 for 8 squares. Color codes can be added to the diagram to identify favorable ranges (with lower score values) and unfavorable ranges. Other types of display can also be used, such as for example a display of the needle-and-dial type.

Thus if, for example, a driver sees a high value, then the driver can immediately change driving style, e.g. accelerate more gradually, taking bends more slowly, etc. The driver will immediately see the effect of this change on the display. This type of indication enables a driver to optimize economy driving performance. In the case of fleets of vehicles, these indications can also be transmitted in instantaneous form or averaged, e.g. per journey or per day, for use by the fleet manager or a driving instructor, by known means such as wireless communication (Bluetooth, GSM, etc.) or in any other way (manual transfer by direct connection or memory).

TABLE 3

| Decision table for visual diagram | | | | | | | | | |
|---|---|---|---|---|---|---|---|---|---|
| | Acceleration found (m/s$^2$) | Score increment | | | | | | | |
| | | 1 | 2 | 3 | 4 | 5 | 6 | 7 | 8 |
| Speed range (upper limit in km/h) | 2.5 | 0.76 | 0.84 | 0.91 | 0.99 | 1.07 | 1.15 | 1.22 | 1.30 |
| | 7.5 | 0.68 | 0.75 | 0.83 | 0.90 | 0.98 | 1.05 | 1.12 | 1.20 |
| | 12.5 | 0.60 | 0.67 | 0.74 | 0.81 | 0.88 | 0.96 | 1.03 | 1.10 |
| | 17.5 | 0.54 | 0.61 | 0.68 | 0.75 | 0.82 | 0.89 | 0.96 | 1.03 |
| | 22.5 | 0.48 | 0.55 | 0.61 | 0.68 | 0.75 | 0.82 | 0.88 | 0.95 |
| | 27.5 | 0.44 | 0.50 | 0.57 | 0.63 | 0.69 | 0.76 | 0.82 | 0.88 |
| | 32.5 | 0.40 | 0.46 | 0.51 | 0.57 | 0.63 | 0.69 | 0.74 | 0.80 |
| | 37.5 | 0.36 | 0.42 | 0.47 | 0.53 | 0.58 | 0.64 | 0.70 | 0.75 |
| | 42.5 | 0.32 | 0.37 | 0.43 | 0.48 | 0.54 | 0.59 | 0.64 | 0.70 |
| | 47.5 | 0.28 | 0.33 | 0.39 | 0.44 | 0.49 | 0.55 | 0.60 | 0.65 |
| | 52.5 | 0.24 | 0.29 | 0.34 | 0.40 | 0.45 | 0.50 | 0.55 | 0.60 |
| | 57.5 | 0.22 | 0.26 | 0.31 | 0.35 | 0.40 | 0.45 | 0.50 | 0.55 |
| | 62.5 | 0.20 | 0.24 | 0.29 | 0.33 | 0.37 | 0.42 | 0.46 | 0.50 |
| | 67.5 | 0.18 | 0.23 | 0.27 | 0.32 | 0.36 | 0.40 | 0.44 | 0.48 |
| | 72.5 | 0.16 | 0.21 | 0.25 | 0.29 | 0.33 | 0.37 | 0.41 | 0.45 |
| | 77.5 | 0.14 | 0.18 | 0.22 | 0.26 | 0.30 | 0.34 | 0.38 | 0.42 |
| | 82.5 | 0.12 | 0.16 | 0.20 | 0.24 | 0.28 | 0.32 | 0.36 | 0.40 |
| | 87.5 | 0.10 | 0.14 | 0.18 | 0.22 | 0.26 | 0.30 | 0.34 | 0.37 |
| | 92.5 | 0.08 | 0.12 | 0.16 | 0.20 | 0.24 | 0.28 | 0.32 | 0.35 |

The figures and the description made above are intended to illustrate the invention but not restrict it. In particular, the invention and its different variants have been described here for very short journeys, purely for purposes of demonstration.

However, the device and the process are efficient for much longer journeys. In addition, on long journeys, some indications supplied by the device can enable a driver to adopt a more economic driving style in order to make fuel savings. For vehicle fleets, in particular trucks and buses, the potential savings are substantial.

The reference signs in the claims are not limiting. The verbs "comprise" and "include" shall not be understood to exclude items other than those listed in the claims. The word "a(n)" before an item shall not be understood to exclude other such items.

The invention claimed is:

1. A device to evaluate how economically a vehicle is being driven, comprising: an obtaining unit configured to obtain at least one physical parameter and to determine, at any given time, a value of a speed and a value of an instantaneous acceleration of a traveling vehicle;

a calculation and comparison unit configured to calculate, from the at least one physical parameter, an effective parameter that depends on the instantaneous acceleration and to compare the effective parameter with a reference parameter;

a driving evaluation unit configured to generate a driving energy score, by measuring a variance between the effective parameter and the reference parameter, wherein the driving energy score for the vehicle is solely or mostly related to how the vehicle is being driven, and is not solely or mainly related to fuel consumption linked to a vehicle engineering feature, and wherein generating the driving energy score includes removing the effects specific to the vehicle and those of the outside ambient conditions; and a display unit configured to display the driving energy score.

2. The device to evaluate how economically a vehicle is being driven according to claim 1, further comprising a geopositioning device.

3. The device to evaluate how economically a vehicle is being driven according to claim 2, further comprising a speed and acceleration calculation unit configured to calculate a speed and an acceleration of the vehicle, wherein the speed and the acceleration of the vehicle can be determined from data on a geographical location of the vehicle provided by the geopositioning device, and wherein the speed and acceleration calculation unit is connected to the geopositioning device.

4. The device to evaluate how economically a vehicle is being driven according to claim 2, wherein the display unit displays a graphical display related to the driving energy score.

5. The device to evaluate how economically a vehicle is being driven according to claim 1, wherein the driving energy score is not solely or mainly related to a physical characteristic of a route traveled.

6. The device to evaluate how economically a vehicle is being driven according to claim 1, wherein the driving energy score is not solely or mainly related to an environmental traveling condition.

7. The device to evaluate how economically a vehicle is being driven according to claim 1, wherein the driving energy score is not solely or mainly related to a vehicle specification.

8. A process to evaluate how economically a vehicle is being driven, comprising the following steps:

obtaining, by an obtaining unit configured to obtain, at least one physical parameter, wherein it is possible, at any given time, to determine a value of a speed and a value of an instantaneous acceleration of a traveling vehicle;

calculating, by a calculation and comparison unit configured to calculate, an effective parameter from the at least one physical parameter, wherein the effective parameter depends on the instantaneous acceleration or the speed of the vehicle;

comparing, by a calculation and comparison unit configured to compare, the calculated effective parameter with a reference parameter;

generating, by a driving evaluation unit configured to generate, a driving energy score according to a variance between the effective parameter and the reference parameter, wherein the driving energy score is solely or mainly related to how economically the vehicle is being driven, and is not solely or mainly related to fuel consumption linked to a vehicle engineering feature, and wherein generating the driving energy score includes removing the effects specific to the vehicle and those of the outside ambient conditions; and displaying, by a display unit, the driving energy score.

9. The process to evaluate how economically a vehicle is being driven according to claim 8, wherein the effective parameter and the reference parameter are functions of at least one parameter chosen from a list comprising: speed, longitudinal acceleration, transverse acceleration, energy, work, power, incline, road bend radius, and geographical location.

10. The process to evaluate how economically a vehicle is being driven according to claim 8, wherein the at least one physical parameter is the location of the vehicle at any given time.

11. The process to evaluate how economically a vehicle is being driven according to claim 10, wherein the geographical location is determined by a geopositioning system.

12. The process to evaluate how economically a vehicle is being driven according to claim 8, wherein the at least one physical parameter is an instantaneous speed.

13. The process to evaluate how economically a vehicle is being driven according to claim 8, wherein the physical parameter is an instantaneous acceleration.

14. The process to evaluate how economically a vehicle is being driven according to claim 8, wherein the driving energy score is a function of a variance between a measured energy value and a reference energy value.

15. The process to evaluate how economically a vehicle is being driven according to claim 14, wherein the reference energy value depends on a rate of energy consumption and on a time or a length of a journey.

16. The process to evaluate how economically a vehicle is being driven according to claim 8, wherein the display unit displays a graphical display related to the driving energy score.

17. The process to evaluate how economically a vehicle is being driven according to claim 8, wherein the driving energy score is not solely or mainly related to a physical characteristic of a route traveled.

18. The process to evaluate how economically a vehicle is being driven according to claim 8, wherein the driving energy score is not solely or mainly related to an environmental traveling condition.

19. The process to evaluate how economically a vehicle is being driven according to claim 8, wherein the driving energy score is not solely or mainly related to a vehicle specification.

* * * * *